US007765926B2

(12) United States Patent
Rancourt et al.

(10) Patent No.: US 7,765,926 B2
(45) Date of Patent: Aug. 3, 2010

(54) WEB PRINTING PRESS WITH DELIVERY STREAM LENGTH DETERMINATION

(75) Inventors: Michael Raymond Rancourt, Merrimack, NH (US); George Athans, Lee, NH (US); Christophe Rifflart, Portsmouth, NH (US); Kevin Lauren Cote, Frisco, TX (US)

(73) Assignee: Goss International Americas, Inc., Durham, NH (US)

( * ) Notice: Subject to any disclaimer, the term of this patent is extended or adjusted under 35 U.S.C. 154(b) by 605 days.

(21) Appl. No.: 11/703,851

(22) Filed: Feb. 8, 2007

(65) Prior Publication Data

US 2008/0190309 A1 Aug. 14, 2008

(51) Int. Cl.
*B41F 13/54* (2006.01)

(52) U.S. Cl. ..... 101/228; 101/227; 101/232; 101/483; 101/485

(58) Field of Classification Search ..... 101/227, 101/228
See application file for complete search history.

(56) References Cited

U.S. PATENT DOCUMENTS 3,237,973 A * 3/1966 Rumberger ..... 101/485
4,346,446 A 8/1982 Erbstein et al.
5,458,062 A * 10/1995 Goldberg et al. ..... 101/485
5,483,893 A 1/1996 Isaac et al.
5,818,719 A * 10/1998 Brandon et al. ..... 700/125
6,837,159 B2 * 1/2005 Elkotbi et al. ..... 101/227
7,036,413 B2 5/2006 Hartmann et al.
2005/0193907 A1 9/2005 Richards et al.
2006/0219115 A1 10/2006 Gentle et al.

* cited by examiner

*Primary Examiner*—Jill E Culler
(74) *Attorney, Agent, or Firm*—Davidson, Davidson & Kappel, LLC

(57) ABSTRACT

A printing press is provided including at least one print unit printing a first job on a web, a folder splitting the web into a plurality of ribbons, combining the ribbons, and cutting the ribbons into signatures, the folder having a folder delivery for delivery of the signatures, a marking device marking every ribbon, a sensor sensing the marks on every ribbon, and a controller connected to the marking device and the sensor and determining a shortest ribbon value and a longest ribbon value, the shortest ribbon value being a function of a shortest path length of a first ribbon through the folder and the longest ribbon value being a function of a longest path length of a further ribbon through the folder. A method is also provided.

18 Claims, 4 Drawing Sheets

WEB PRINTING PRESS WITH DELIVERY STREAM LENGTH DETERMINATION

BACKGROUND

The present invention relates generally to web printing presses.

U.S. Patent Application Publication No. 2006/0219115 A1, hereby incorporated by reference herein, discloses an offset web print unit including a plate cylinder, a blanket cylinder, a second blanket cylinder, an auto-plating mechanism, and a throw-off mechanism. The print unit allows for large movement of the blanket and plate cylinders in an effective manner while maintaining auto-plating capability.

A web printing press typically will print a web of material using, for example, four print units, each one printing a certain color. The web may then be slit into ribbons, processed and recombined in a folder. The folder cuts signatures from the recombined ribbons, the signatures are then delivered to form for example, newspapers or magazine sections.

When a printing press changes from one job to another, for example, from printing a sports magazine and then a business magazine, the lengths in the delivery stream between the print units and the folder delivery may change.

BRIEF SUMMARY OF THE INVENTION

The present invention provides a printing press comprising:

at least one print unit printing a first job on a web;

a folder splitting the web into a plurality of ribbons, combining the ribbons, and cutting the ribbons into signatures, the folder having a folder delivery for delivery of the signatures;

a marking device marking every ribbon;

a sensor sensing the marks on every ribbon; and a controller connected to the marking device and the sensor and determining a shortest ribbon value and a longest ribbon value, the shortest ribbon value being a function of a shortest path length of a first ribbon through the folder and the longest ribbon value being a function of a longest path length of a further ribbon through the folder.

The present invention further provides a method for determining printed ribbon lengths comprising the steps of:

printing a web of material with at least one printing unit;

splitting the web into ribbons;

marking each ribbon of the ribbons with a mark; and detecting the mark on each ribbon;

determining a longest ribbon value as a function of the detecting, the longest ribbon value being a function of a longest distance a longest ribbon of the ribbons travels through a folder; and determining a shortest ribbon value as a function of the detecting, the shortest ribbon value being a function of a shortest distance a shortest ribbon of the ribbons travels through the folder.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

The number of acceptable copies (impressions) between the print units and the folder delivery is generally unknown or only estimated. For example, when the press stops for a job change, there may still be 100 good products on the web and ribbons after the print units from the previous job which can be made. However, many of these products often are discarded, since it is not known how many potential good products are available or where the good products are located.

In addition, when the next job starts, good copies of the next job also may be discarded, via a waste gate. The next product only starts being delivered by estimating when good products for the next job are past the waste gate.

The present invention advantageously permits accurate determination of the number of good products that can be delivered. This is especially advantageous when used with continuous running printing presses.

Figure 1:
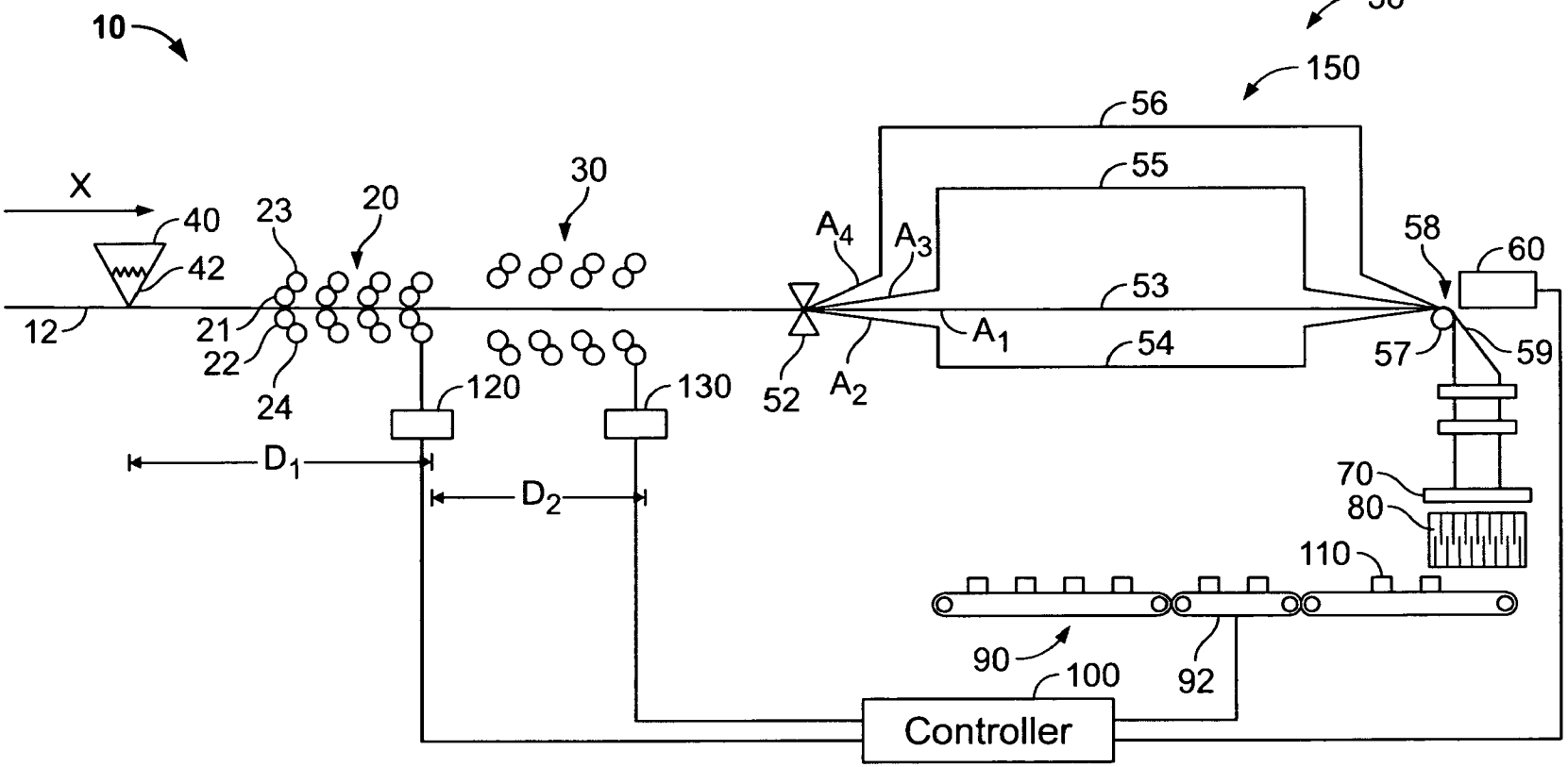
FIG. 1 shows a printing press according to the present invention.
Figure 2:
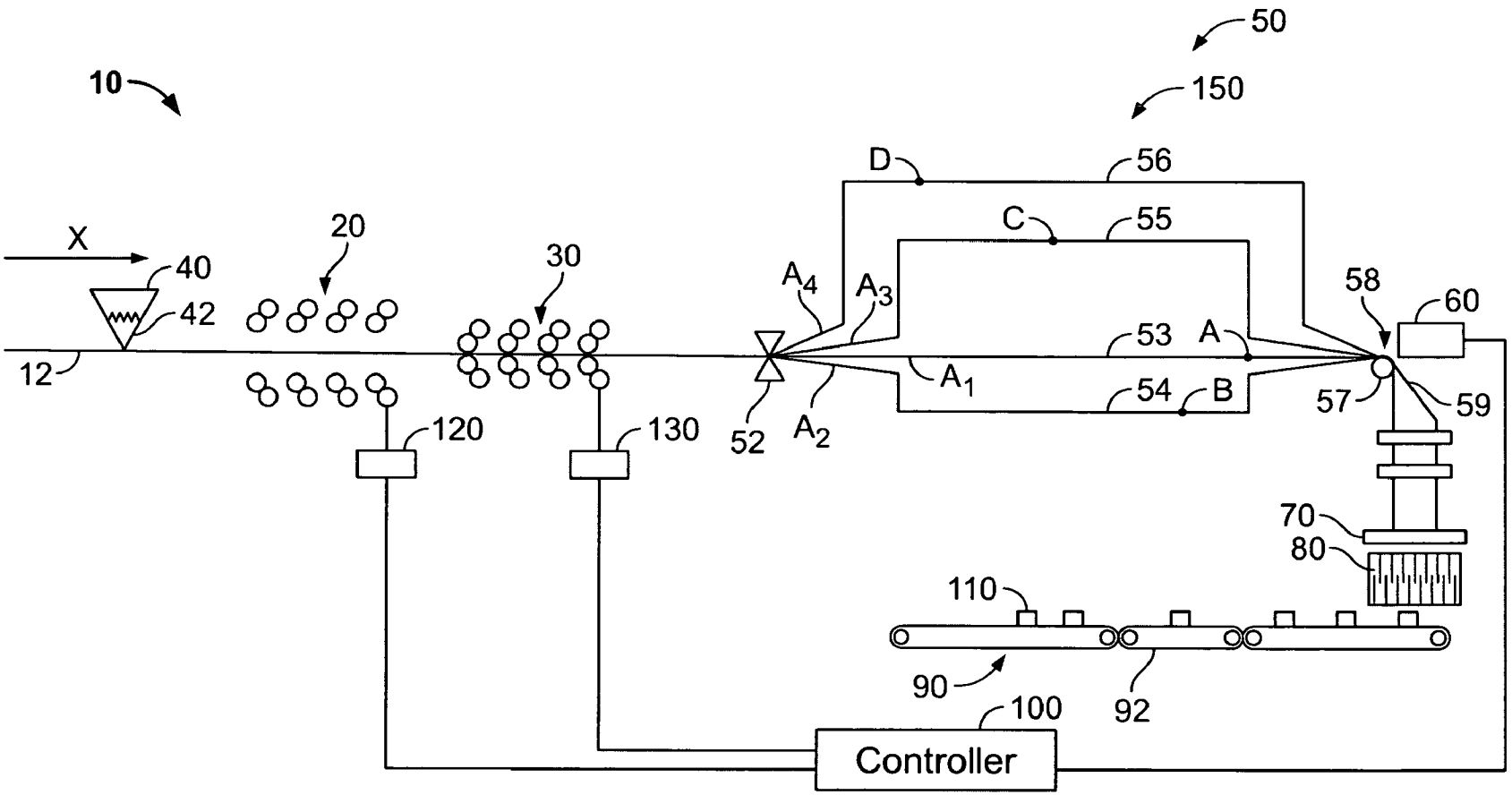
FIG. 2 shows the printing press in FIG. 1 running two print jobs simultaneously.

FIGS. 1 and 2 show a preferred embodiment of a printing press 10 including first and second offset printing sections 20, 30, folder 50 having folder superstructure 150, cutting device 70 and fan 80. Fan 80 delivers to a conveyor 90. The first and second printing sections 20, 30 may include offset printing units and include multiple cylinders, for example, each printing section 20, 30 may include 4 offset printing units in a four color printing arrangement. Each printing unit may include 2 plate cylinders 21, 22 and two blanket cylinders 23, 24. A controller 100 receives and transmits signals to the printing press 10. A web 12 travels through printing press 10 in a direction X.

First and second printing sections 20, 30 may print on web 12 in an alternating manner. Thus, when a job A is running, first printing section 20 is printing a product A on web 12 and second printing section 30 is not printing on web 12. Subsequently, when a job B is running, second printing section 30 is printing a product B on web 12 and first printing section 20 is not printing on web 12.

A first counter 120 connected to first printing section 20 counts the number of job A impressions printed on web 12 by first printing section 20. A second counter 130 connected to second printing section 30 counts the number of job B impressions printed on web 12 by second printing section 30. The first and second counters 120, 130 are connected to controller 100.

A marking device 40 can mark web 12 after folder superstructure 150 is properly configured for job A or job B, but before printing begins for each product A, B. The web 12 is marked with a substance 42, for example, a ferromagnetic ink. (See FIG. 4).

Folder 50 located downstream from first and second printing sections 20, 30 includes a slitter 52 to longitudinally slit web 12 into ribbons 53, 54, 55, 56. Folder superstructure 150 includes a roller top of former 57 and a former 59. A folder configuration for job A may run ribbons 53, 54, 55, 56 along paths $A_1$, $A_2$, $A_3$, $A_4$. For a job B, where the ribbon paths stay the same, as shown in FIG. 2, the printing press may be run continuously as job A is switched to job B.

Figure 3:
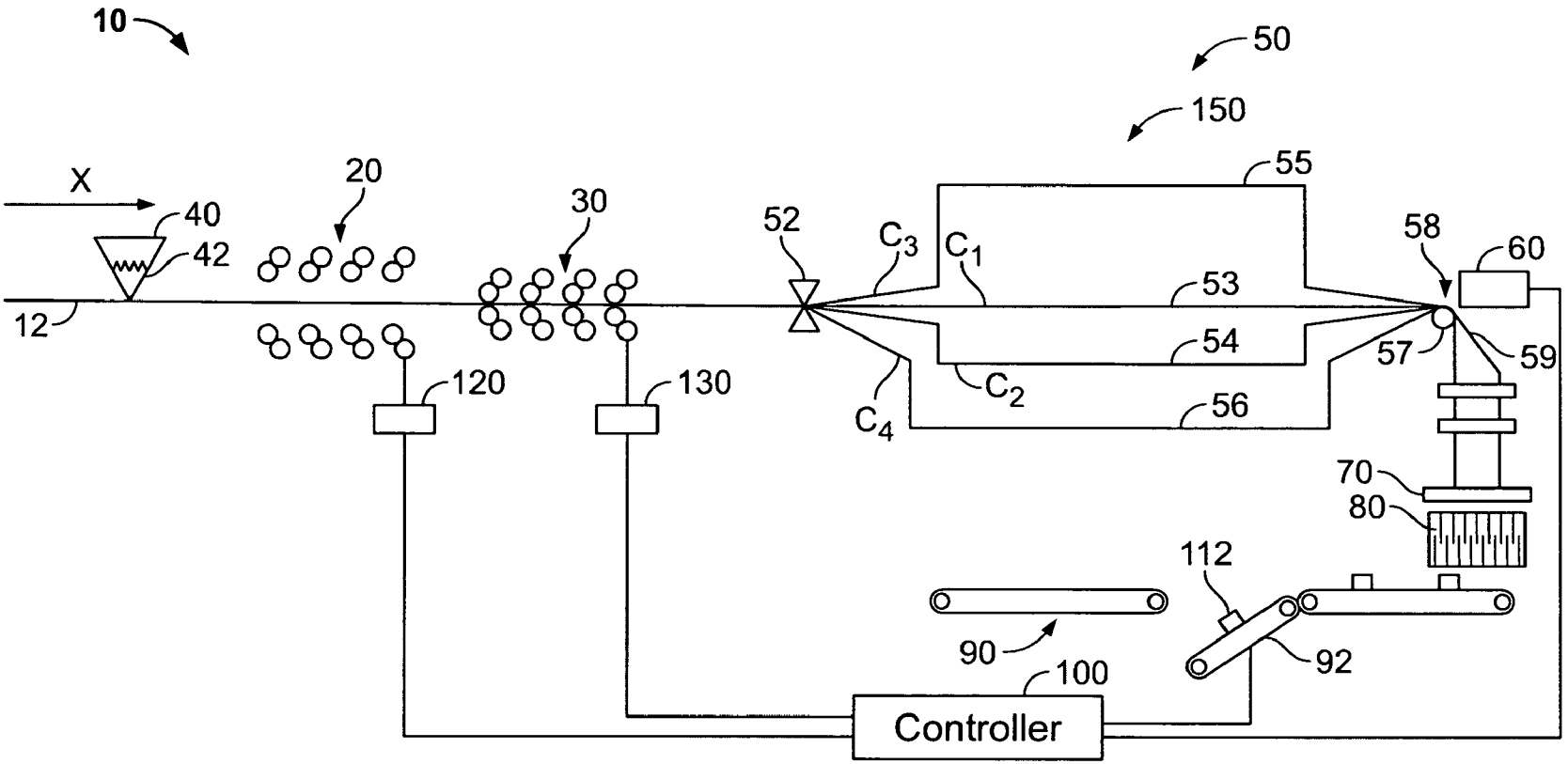
FIG. 3 shows a waste gate of the printing press in an open position.
Figure 4:
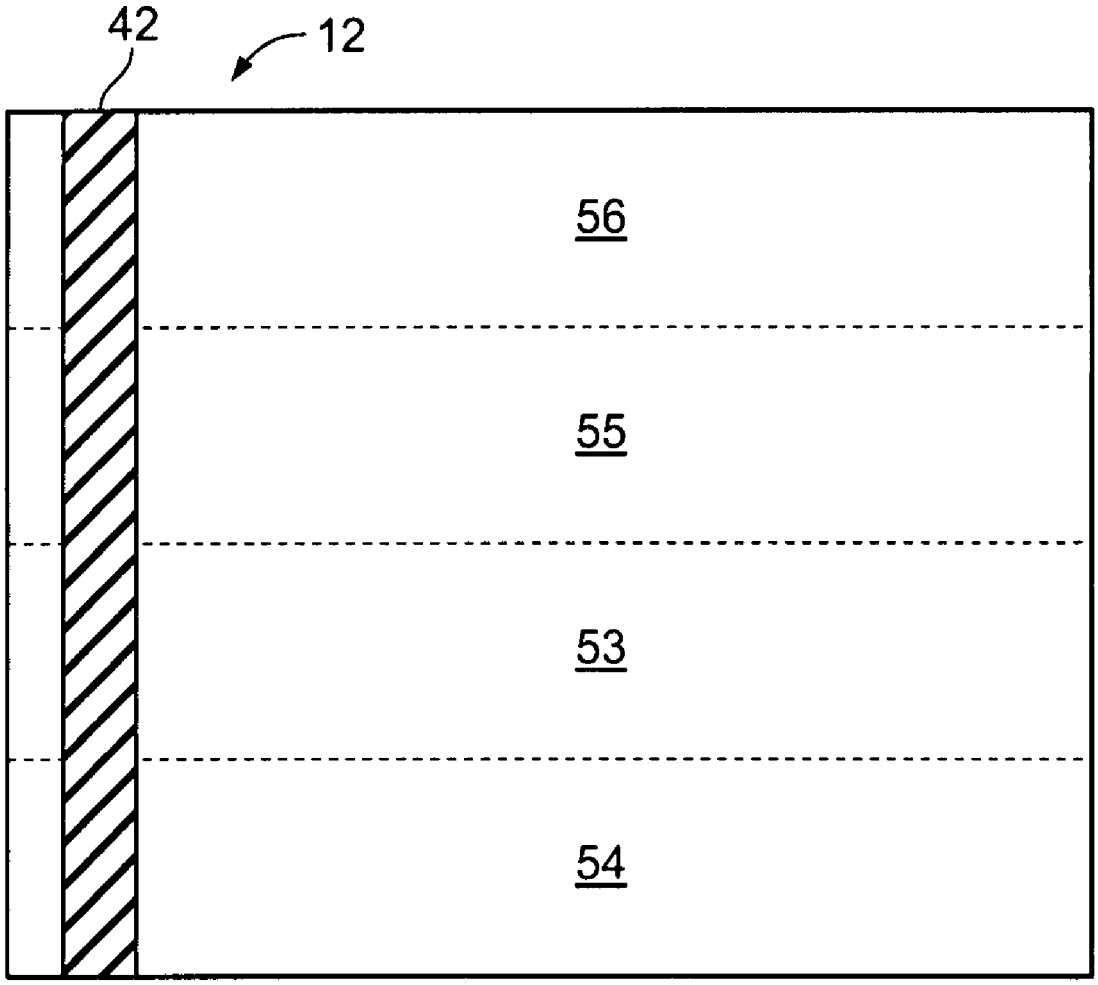
FIG. 4 shows a web according to the present invention.

A further folder configuration for job C may run ribbons 53, 54, 55, 56 along paths $C_1$, $C_2$, $C_3$, $C_4$ as shown in FIG. 3. This requires a web splice and shutting down of the printing press. Marking device 40 marks web 12 in such a way that each ribbon 53, 54, 55, 56 includes a detectable amount of substance 42 as shown in FIG. 4.

The ribbon paths $A_1$, $A_2$, $A_3$, $A_4$ are reconfigured or adjusted only when the job being printed so requires. The paths $A_1$, $A_2$, $A_3$, $A_4$ may be different lengths and include a short path $A_1$, having the shortest length, and a long path $A_4$, having the longest length. Ribbon 56 needs more time to run through folder superstructure 150 than ribbon 53 since path $A_4$ is longer than path $A_1$. Turner bars may be used in the folder superstructure 150 to manipulate the length of each ribbon path $A_1$, $A_2$, $A_3$, $A_4$.

Further downstream in folder 50, roller top of former 57 gathers job A ribbons 53, 54, 55, 56 into a ribbon bundle 58. A sensor 60 detects substance 42 on each ribbon 53, 54, 55, 56 after ribbon bundles 58 are formed. Sensor 60 may be magnetic and detect ferromagnetic ink. Former 59 then longitudinally folds ribbon bundles 58.

Folded ribbon bundles 58 exit folder 50 and are cross cut by a cutting cylinder 70 into completed signatures 110. A fan 80 deposits signatures 110 on conveyor 90 for further processing. Each complete job A signature 110 includes an impression from each of the job A ribbons 53, 54, 55, 56.

Conveyor 90 includes a dump gate 92. Dump gate 92 is connected to controller 100. Dump gate 92 provides an alternative pathway for incomplete, improperly configured or rejected signatures 112. Thus, signatures 112 composed of improperly configured ribbons or signatures during a job change will be diverted via dump gate 92. (See FIG. 3). Such improper signatures occur during a job change, because some signatures will have both a product A impression and a product B impression due to the uneven path lengths in the folder superstructure.

FIG. 1 shows product A being printed on printing press 10 forming signatures 110. Folder 50 is properly configured for job A. Web 12 is marked once with substance 42 by marking device 40. A distance D1 between the marking device 40 and the last print unit of section 20 is known, as is the web speed. When the substance 42 passes the last print unit of section 20, counter 120 begins counting the number of impressions printed on web 12.

Sensor 60 detects the substance 42 on each ribbon 53, 54, 55, 56, as the ribbon bundles 58 pass sensor 60. When a first mark is detected, the counter 120 sends controller 100 the number of impressions printed during the time when the mark exits print section 20 and when the first mark is detected. Thus, the number of impressions printed across the shortest path length $A_1$ is known. The sensor 60 also then detects the next two marks and then the last mark from ribbon 56. As the last mark is detected, counter 120 sends controller 100 the number of impressions printed during the time when the mark exits print section 20 and the last mark is detected. Thus, the number of impressions printed across the longest path length $A_4$ is known. Controller 100 can determine if the mark is the last mark, for example, by knowing the number of ribbons and counting the marks which pass or by storing counts with each mark and waiting a certain amount of time, for example, based on a longest web path permissible, to ensure the last mark has passed.

For example, ribbon 53 traveled through folder 50 via short path $A_1$ and sixty impressions were counted during the time between exiting the section 20 and sensing by sensor 60. Ribbon 56 traveled through folder 40 via long path $A_4$ and ninety impressions were counted for the time. Seventy impressions were counted for ribbon 54 and eighty impressions were counted for ribbon 55. A set of job path data 102 is created for job A. The set of job data 102 includes the number of impressions counted along short path $A_1$, short value $\mathbf{101}_S$, and long path $A_4$, long value $\mathbf{102}_L$. Thus set 102 includes short and long values [$\mathbf{102}_S$, $\mathbf{102}_L$]. The short and long values $\mathbf{101}_S$, $\mathbf{102}_L$ are stored by controller 100 for future use, together with which print section 20 or 30 was used to print the web.

Printing section 20 continues printing product A on web 12. The properly configured ribbon bundles 58 then are formed by roller top of former 57, longitudinally folded by former 59 and cross cut by cutting cylinder 70 to result in properly configured signatures 10. Fan 80 now deposits properly configured signatures 10 onto conveyor 90 for further transport and waste gate 92 is closed. The distance between roller top of former 57 and waste gate 92 is known.

In FIG. 2, a second print job is to be printed, requiring the exact same folder configuration. However, the printing press 10 configuration is changed so printing section 30 prints product B on web 12. Section 20 stops printing, and section 30 prints on blank web 12 once the A job passes the last print unit of section 30, since a distance D2 between the last print units of each section 20, 30 is known (see FIG. 1). After printing section 30 begins printing, both job A and job B then are being run through folder 50 for a certain time. Since long path $A_4$ is longer than short path $A_1$, a longer amount of time is needed for job B impressions on ribbon 56 to reach roller top of former 57 via long path $A_4$.

For example, points A, B, C, and D indicate where the printing job changed from job A to job B. Downstream of points A, B, C and D, job A impressions are printed on ribbons 53, 54, 55, 56, respectively. Upstream of points A, B, C and D, job B impressions are printed on ribbons 53, 54, 55, 56, respectively.

Subsequently, ribbon bundles 58 forming at roller top of former 57 are improperly configured when ribbons 53, 54, 55, 56 printed with job A are combined with ribbons 53, 54, 55, 56 printed with job B. Thus, controller 100 uses short value 102S to determine how many properly configured ribbon bundles 58 will be formed before ribbons 53, 54, 55, 56 printed with job B begin combining with ribbons 53, 54, 55, 56 printed with job A. This occurs the instant point A on ribbon 53 printed with job B starts to combine with job A impressions printed on ribbons 54, 55, 56.

As soon as job B printing begins, short value 102S is used to determine that sixty impressions of job A on ribbon 53 passing through folder 50 via short path $A_1$ will combine with job A ribbons 54, 55, 56 to form sixty more properly configured ribbon bundles 58. The sixty-first impression on path $A_1$ is a job B impression, the sixty-first impression lies upstream of point A. As such, the sixty corresponding signatures 110 deposited by fan 80 onto conveyor 90 will be properly configured. Thus, short value 102S is used to determine the number of properly configured ribbon bundles 58 remaining in job A.

After the sixtieth job A impression from path $A_1$ is combined into a ribbon bundle 58, subsequent ribbon bundles 58 for a certain time will include at least one ribbon 53, 54, 55, 56 printed with job A and at least ribbon 53, 54, 55, 56 printed with job B and result in improperly configured signatures. Fan 80 deposits these improperly configured products onto conveyor 90. In conjunction with the short value 102S and the known distance between sensor 60 at roll top of former 58 and the waste gate 92, controller 100 activates waste gate 92 when the last properly configured job A signatures 110 pass waste gate 92. Waste gate 92 then begins dumping or diverting improperly configured signatures.

Once point D on ribbon 56 reaches roll top of former 57, properly formed B products form. As a proper B product approaches waste gate 92, the waste gate 92 can be repositioned to permit delivery of the B products. This is easy to determine from the long value $102_L$, here ninety impressions, so that after thirty bad products are discarded, the waste gate 92 is reset. No good products need to be discarded. In reality, changeovers and timing of the print unit may not be perfect, and distances may not be an integral number with respect to the impression length, so that a number of impressions thought to be good, for example five, can be set to be discarded on either side of the estimated bad products.

There need be only one marking for each folder configuration, since the distance D2 is known. Thus, for example, if printing is switched back to section 20 with a change in folder configuration, the stored short value $102_S$ and long value $102_L$ can be reduced by the distance D2 (as impression length is known).

For various jobs, the configuration for folder 50 also may be changed as shown in FIG. 3. This typically occurs with a web splice when the printing press is stopped. After the configuration is changed, marking device 40 marks web 12 once with substance 42 and begins printing product C. Counter 130 counts the number of impressions being printed on web 12 once the substance 42 passes the last print unit of section 30. Sensor 60 detects the substance 42 on each ribbon 53, 54, 55, 56, as the ribbon bundles 58 pass sensor 60. When a first mark is detected, the counter 130 sends controller 100 the number of impressions printed during the time when web 12 is marked and the first mark is detected. Thus, the number of impressions printed across the shortest path length C, is known. The sensor 60 also then detects the next two marks and then the last mark from ribbon 56. As the last mark is detected the counter 130 sends controller 100 the number of impressions printed during the time when web 12 is marked and the last mark is detected. Thus, the number of impressions printed across the longest path length $C_4$ is known.

Controller 100 stores a set of job data 104 for job C including the number of impressions counted along short path $C_1$, short value $104_S$, and long path $C_4$, long value $104_L$, and also which print section 20 or 30 was used for printing. For example, short value $104_S$ may be seventy impressions and long value 104L may be one hundred impressions. Long value 104L represents the number of impressions which need to be printed on web 12 for job C to produce one properly configured ribbon bundle 58.

When job C ends, and a print job D with a same folder configuration begins, this data can be used to discard only the bad signatures as described above with respect to jobs A and B. It is noted that when section 20 starts printing, section 20 can be timed so that little or no blanks occur between job C and job D, even though section 20 is upstream from section 30.

As shown in FIG. 4, web 12 is marked with substance 42 so ribbons 53, 54, 55, 56 are marked with substance 42 even after web 12 is slit.

In a further embodiment, a plurality of sensors may be supplied upstream of the roller top of former 57 at known locations to read each ribbon 53, 54, 55, 56, thus permitting use of regular inks. Thus, counters may count the number of impressions between sensors and determine path length from these values. However, this is more expensive and less desirable.

In an alternative embodiment, the marking device may be a spray nozzle. The substance applied to the web may be a ferromagnetic ink. Since the ribbons are overlaid at the roll top of former 57, a ferromagnetic ink may be advantageous so the mark does not need to be visually detected. For example, a magnetic sensor may be used to detect the ink. The substance may be subsequently trimmed off. The mark need only be provided once for each folder configuration and advantageously can be separate from any registration marks and need not be provided on every impression produced by the printing units. In another preferred embodiment, the web may be marked with the substance after the first and second printing units print on products A, B on the web. The longitudinal relationship must be known or determined, for example by additional sensors.

In other alternative embodiments, the web may be split into any multiple of ribbons and multiple paths and path lengths may be selected. The products coming from the quickest and slowest paths need to be detected by the sensor to determine when the waste gate should be opened and closed. Furthermore, counters may only count properly configured products. Even furthermore, data sets of short and long values for each job may be stored and automatically retrieved by a controller.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press comprising:

at least one print unit printing a first job on a web;

a folder splitting the web into a plurality of ribbons, combining the ribbons, and cutting the ribbons into signatures, the folder having a folder delivery for delivery of the signatures;

a marking device marking every ribbon;

a sensor sensing the marks on every ribbon; and a controller connected to the marking device and the sensor and determining a shortest ribbon value and a longest ribbon value, the shortest ribbon value being a function of a shortest path length of a first ribbon through the folder and the longest ribbon value being a function of a longest path length of a further ribbon through the folder.

2. The printing press as recited in claim 1 wherein the mark has magnetic properties.

3. The printing press as recited in claim 1 wherein the mark is ferromagnetic ink.

4. The printing press as recited in claim 1 wherein the sensor is a magnetic sensor.

5. The printing press as recited in claim 1 wherein the controller determines the number of impressions of the longest ribbon and shortest ribbon printed with the first job.

6. The printing press as recited in claim 1 further comprising a waste gate after the folder, the controller controlling the waste gate.

7. The printing press as recited in claim 6 wherein the waste gate is controlled as a function of the shortest ribbon value and the longest ribbon value.

8. The printing press as recited in claim 1 further comprising at least one second print unit printing a second print job on the web when the first print unit is not printing.

9. A method for determining printed ribbon lengths comprising the steps of:

printing a web of material with at least one printing unit;

splitting the web into ribbons;

marking each ribbon of the ribbons with a mark; and detecting the mark on each ribbon;

determining a longest ribbon value as a function of the detecting, the longest ribbon value being a function of a longest distance a longest ribbon of the ribbons travels through a folder; and determining a shortest ribbon value as a function of the detecting, the shortest ribbon value being a function of a shortest distance a shortest ribbon of the ribbons travels through the folder.

10. The method as recited in claim 9 further comprising operating a waste gate as a function of the shortest and longest ribbon values.

11. The method as recited in claim 9 wherein the printing occurs for a first print job, and further comprising switching over to a second print job using a same folder configuration.

12. The method as recited in claim 11 further comprising determining when good products for the first print job are no longer formed as a function of the shortest ribbon value.

13. The method as recited in claim 12 further comprising determining when further good products for the second print job begin to be formed as a function of the longest ribbon value.

14. The method as recited in claim 12 further comprising operating a waste gate to discard bad products after the good products for the first print job are no longer formed.

15. The method as recited in claim 11 further comprising determining when further good products for the second print job begin to be formed as a function of the longest ribbon value.

16. The method as recited in claim 9 wherein the determining of the shortest ribbon value includes determining when the mark for the shortest ribbon passes a last printing unit and when the mark for the shortest ribbon passes a sensor downstream of the last printing unit.

17. The method as recited in claim 9 wherein the mark is separate from any registration mark.

18. The method as recited in claim 9 wherein the mark is not provided to every image.

* * * * *